United States Patent [19]

Hession et al.

[11] 4,135,651

[45] Jan. 23, 1979

[54] DEVICE FOR APPLYING MORTAR

[76] Inventors: Brent M. Hession; Rodney J. Hession, both of P.O. Box 432, Marrero, La. 70073

[21] Appl. No.: 807,505

[22] Filed: Jun. 17, 1977

[51] Int. Cl.[2] ..... B05D 1/26; B05D 1/30; F04G 21/16

[52] U.S. Cl. ..... 222/611; 118/412; 118/415; 401/48; 401/193

[58] Field of Search ..... 401/4, 48, 193; 222/611, 612; 141/235; 239/567; 118/207, 208, 305, 307, 411, 412, 415

[56] References Cited

U.S. PATENT DOCUMENTS

| | | | |
|---|---|---|---|
| 2,683,981 | 7/1954 | Richey | 401/4 |
| 3,162,886 | 12/1964 | Wise | 401/193 X |
| 3,334,792 | 8/1967 | DeVries et al. | 401/48 X |
| 4,043,487 | 8/1977 | Price | 222/611 X |

*Primary Examiner*—David A. Scherbel
*Attorney, Agent, or Firm*—Kemon & Estabrook

[57] ABSTRACT

A device for applying a plurality of spaced beads or ribbons of cementitious material, such as mortar, to a course of masonry units being laid as a wall or the like. A frame member is provided for supporting a plurality of dispensing beads or nozzles that have containers or hoppers associated therewith for delivering mortar to said nozzles in the laying of a ribbon or bead of mortar on a row of bricks or cement blocks. The frame member is also provided with guide members to insure the proper laying of the ribbon or bead of mortar.

8 Claims, 5 Drawing Figures

FIG. 3
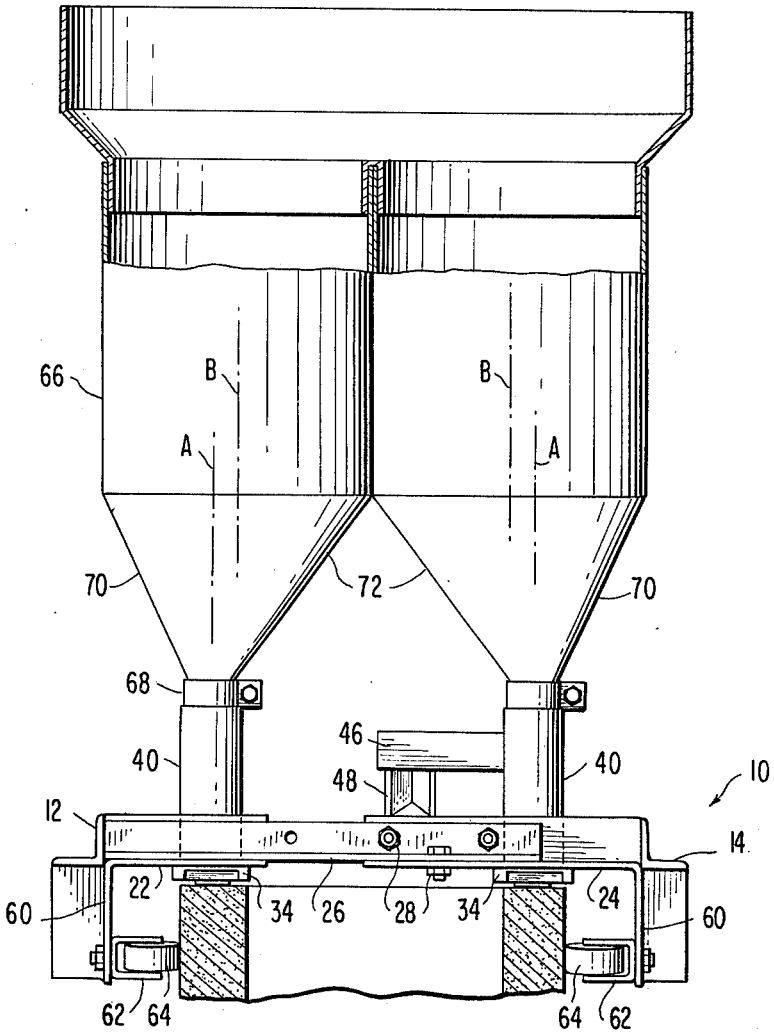
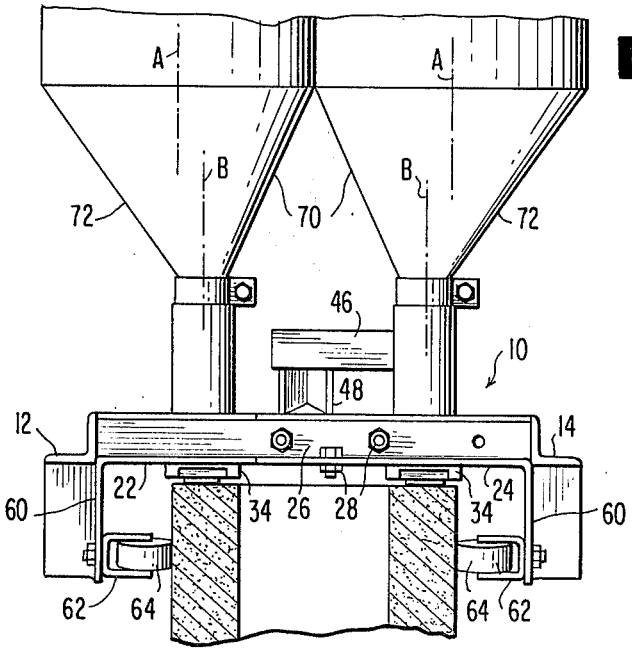
FIG. 4
FIG. 5
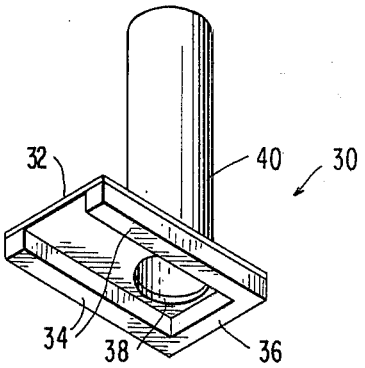

DEVICE FOR APPLYING MORTAR

BACKGROUND OF THE INVENTION

The present invention relates to static structures, such as masonry walls and buildings and particularly to processes for assembling exposed modules, that is brick or block laying and the apparatus associated therewith.

In the laying or running of a course of bricks, cement blocks or the like the conventional practice of manually applying the mortar to each brick or block has usually been followed. The practice of pouring a footing then applying mortar to the upper surface thereof upon which bricks or cement blocks are set is a time consuming and laborious task. The subsequent courses or rows of bricks or cement blocks have the mortar manually applied to a surface thereof as same are being laid. This arrangement usually necessitates the use of skilled labor with the accompanying cost.

In an effort to not only reduce said cost but also to be able to employ unskilled or semi-skilled labor the use of certain mechanical devices has been resorted too. The patent to Stockman U.S. Pat. No. 2,174,394 dated Sept. 26, 1939 is directed to a particular method of laying bricks or cement blocks. A mold or form is clamped in place upon a footing or foundation wall and courses of bricks or cement blocks are then laid within the form with a layer of cement interposed between each course of bricks or blocks. The layer of cement is spread over the entire upper surface of the bricks and blocks and same is leveled or smoothed over by a template or tool. A plurality of such tools are provided with each tool being of a different height and its use being dictated by the height of the wall within the mold or form.

While the foregoing would definitely permit the use of semi-skilled help it would also result in the use of more mortar than would be the case if a skilled bricklayer were employed.

SUMMARY OF THE INVENTION

The present invention is directed to a device for applying running beads or ribbons of mortar to a designated area of a brick or cement block in the course of erecting a masonry wall or building. The device of the instant invention embodies a pair of containers or hoppers having dispensing nozzles associated therewith and which are mounted on and carried by a suitable frame member. The frame member is provided with both supporting and guiding wheels which engage the upper or top most course of blocks or bricks in the wall. The frame member in conjunction with the hoppers or containers are moved along or over the top surface of the uppermost row or course of bricks or blocks in order to deposit beads or ribbons of mortar on the uppermost surface of said cement blocks or bricks. The beads or ribbons of mortar are so disposed on the upper surface of the cement blocks or bricks as to be offset from the outer most edge of said bricks or blocks.

BRIEF DESCRIPTION OF THE DRAWING

FIG. 3 is an end elevational view of the hoppers for applying mortar to a block of a certain size;

FIG. 4 is a view similar to that of FIG. 3 but showing a block of a smaller size; and FIG. 5 is a perspective view of a mortar head or nozzle for depositing a ribbon or bead of mortar on a concrete block.

DESCRIPTION OF THE PREFERRED EMBODIMENT

Figure 1:
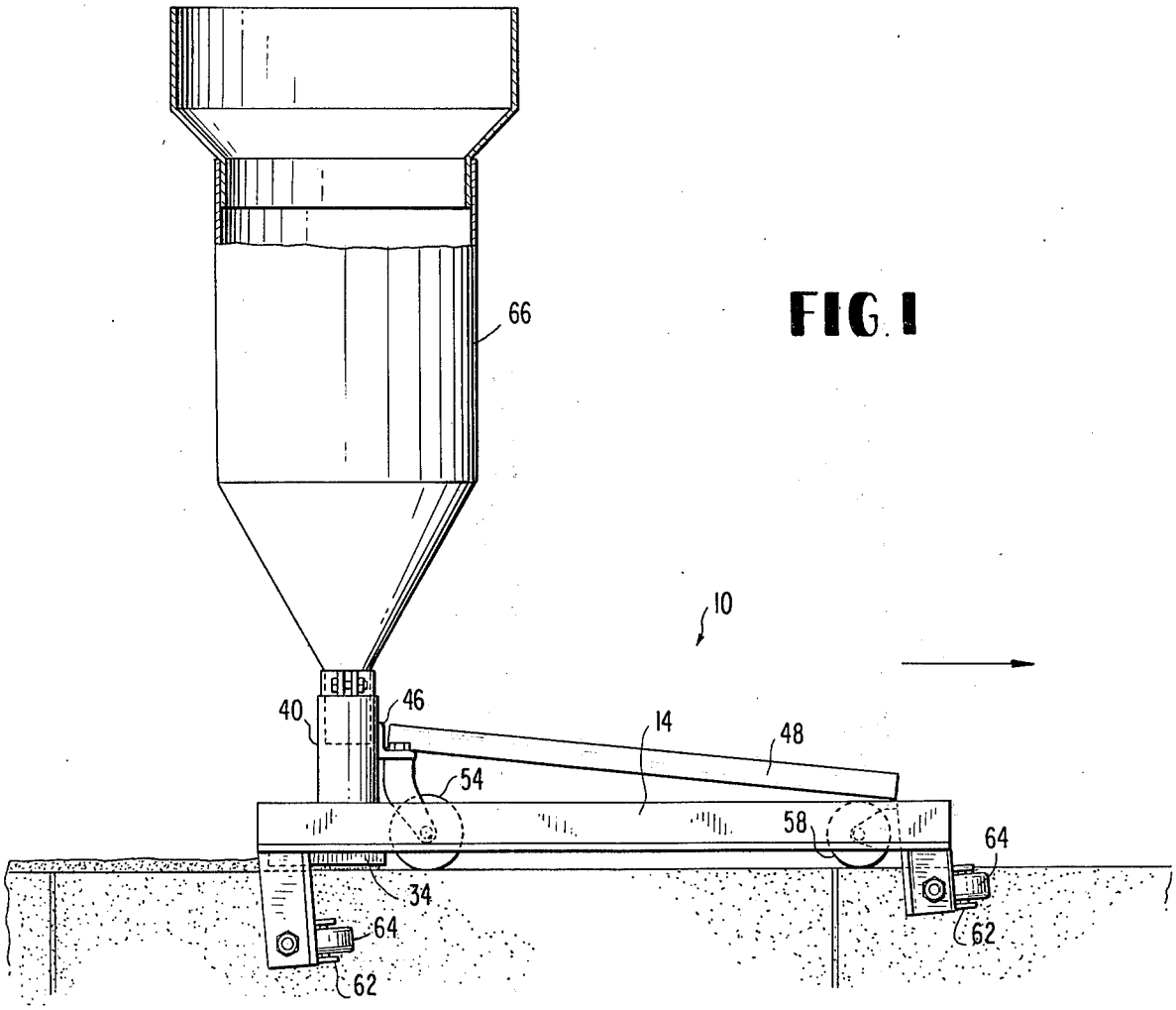
FIG. 1 is a side elevational view of a mortar applying device embodying the present invention.
Figure 2:
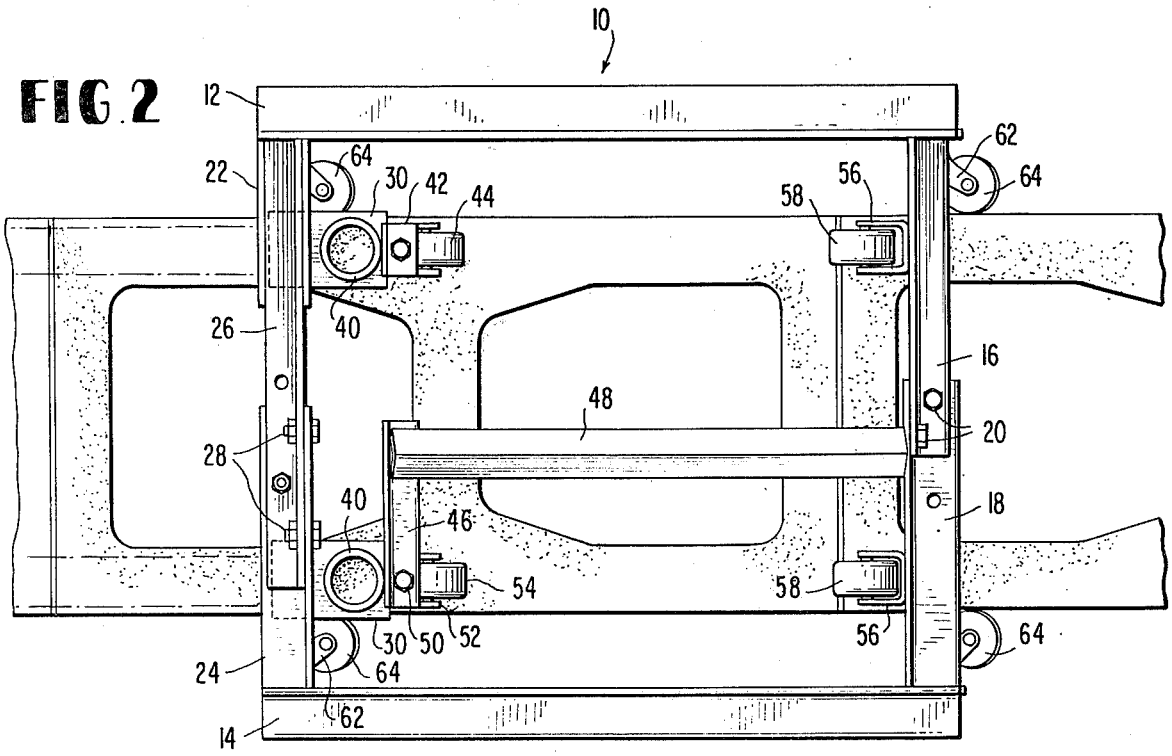
FIG. 2 is a top plan view of the mortar applying device of FIG. 1.

Referring to the drawings there is shown in FIGS. 1 and 2, a rectangular shaped frame member 10 consisting, of side elements or members 12 and 14 secured to one another by suitable end members. One end of the frame member 10 is composed of members or elements 16 and 18 which are secured to the side elements 12 and 14 in planes normal thereto. The innermost ends of the elements 16 and 18 overlap one another and have a sliding fit and same are adjustably secured to one another by suitable fastening members 20.

The other end of the side members 12 and 14 are each provided with an inwardly projecting end segment 22 and 24, respectively. The end segment 22 has one end of a connecting bar member 26 secured thereto by any suitable means, such as welding or the like, not shown. The other end of the connecting bar 26 is adjustably secured to the end segment 24 by suitable fastening members 28. While the frame member 10 can be formed from any suitable material that is sufficiently strong enough to provide a relatively rigid structure throughout, the various members and elements constituting said frame have been illustrated as formed from angle iron. Thus, the side members 12 and 14 are capable of being adjusted towards and away from one another and being retained in said adjusted position by the fastening members 20 and 28 securing the respective end members to one another.

The end segments 22 and 24 each have secured to the lower face thereof a mortar head or dispensing nozzle 30, FIG. 2. As shown in FIG. 5 the mortar head or dispensing nozzle 30 includes a rectangular shaped base member 32 which has secured to the lower face thereof a pair of rib members 34. The rib members 34 are of the same length as the base member 32 and extend along the longitudinal edges of said base member in spaced parallel relation to one another. The rib members 34 are connected to one another at one end of the base member 32 by a transverse rib member 36 so that a channel is defined on the lower face of the base member 32 which channel is opened at one end of said base member. The base member 32 is provided at the end adjacent the transverse rib member with an aperture 38 which has associated therewith a tubular conduit 40 that is disposed in a plane normal to the top surface of the base member 32.

As shown in FIG. 2 a pair of mortar heads or dispensing nozzles 30 are secured to the frame member 10 with the upper surface of the base member 32 of the dispensing nozzle being secured, by any suitable means, to the lower face of the end segment 22 and 24. This arrangement positions the tubular conduits 40 within the frame member 10 adjacent the end segments 22 and 24. The dispensing nozzle 30, that is carried by the end segment 22 of the frame member 10, has secured to its inner end a bifurcated bracket member 42 that has a wheel 44 rotatably mounted therein.

The mortar head or dispensing nozzle 30, that is connected to and carried by the end segment 24, has secured to its inner end an angle bar 46 that is arranged in spaced parallel relation to the end segment 24. The free end of the bar 46 has secured thereto by any suitable means one end of a handle 48 that extends towards the end segments 16 and 18 of the frame member. The bar member 46 has affixed thereto by a fastening member 50 a bifurcated bracket 52 which has rotatably mounted therein a wheel 54. The end members 16 and 18 each have a bifurcated bracket 56 secured thereto which bracket has rotatably mounted therein a wheel 58. The wheels 58 and 54 and 44 constitute load bearing elements for the frame 10 and readily facilitate the movement of the frame member 10 over the upper surface or course of bricks or cement blocks during the application of mortar to the upper surface of said blocks or bricks.

The end members 16 and 18 and the end segments 22 and 24 each have one leg of an angle bracket 60, FIGS. 3 and 4, secured thereto by any suitable means. The remaining leg of the bracket 60 is depending from the segments 22 and 24 and said leg has a bifurcated bracket 62 secured thereto. The brackets 62 each have a wheel 64 rotatably mounted therein. The conduits 40 of each mortar head or dispensing nozzle 30 has a hopper or container 66 mounted therein which is secured to said conduit by means of suitable clamps 68.

In the use of the device of the present invention in the assembling or laying of bricks or blocks in a wall or the like a foundation or footing is poured or constructed in the usual and customary manner and on said footing or foundation is laid the first row or course of bricks or cement blocks. The first row or course of cement blocks is carefully laid in the usual and customary manner, after which, the frame 10 is placed upon the top surface of said row of cement blocks with the wheels 58, 54 and 44 engaging said surface and supporting said frame member thereon. The frame unit 10 is then adjusted to the size or width of the cement block by removing the fastening members 20 and 28 and moving the end members 16 and 18 and the end segments 22 and 24 towards or away from one another until the guide wheels 64 engage the side faces of the cement block, see FIGS. 2 and 3. The frame unit 10 having been so adjusted the fastening elements 20 and 28 are tightened so as to properly hold the side elements or members 12 and 14 through the end members and segments to wherein the wheels 64 will ride along the inner and outer side faces of the cement block while the wheels 58, 54 and 44 are moving along the top surface of the blocks. With the frame properly positioned upon the first row or course of cement blocks the hoppers or containers 66 are than filled with a cementitious material, such as mortar or the like, and the frame is then manually drawn along and over the first row or course of cement blocks by means of the handle 48. This movement will cause the mortar to flow from the hopper or containers 66 through the conduit 40 and dispensing nozzles 30 and onto the top surface of the row of cement blocks.

The guide wheels 64 by engaging the inner and outer faces of the row or course of cement blocks will allow the dispensing nozzles 30, in moving over the top most surface of the row of blocks, to deposit a ribbon or bead of cementitious material upon the upper surface of the blocks. The ribbon or bead of cementitious material deposited by each nozzle 30 will be spaced inwardly from the vertical face of the cement block by a distance equal to the thickness of the rib members 34 provided on the base member 32 of the mortar head or dispensing nozzle 30. This inward spacing of the beads or ribbons of cementitious material will permit said material to flow inwardly and outwardly towards the vertical faces of said cement blocks when the next row or course of blocks is placed upon the mortar that has just been laid by the frame member 10. The mortar heads or dispensing nozzles 30 will through their configuration insure that the ribbon or bead of cementitious material being laid upon each row or course of blocks will be of uniform thickness and width throughout the entire wall or building.

The foregoing is accomplished by having the dispensing nozzle aperture 38 located at one end of the base member 32 so that as the cementitious material flows through the aperture 38 onto the upper surface of the row of cement blocks the base member 32 will be drawn over said cementitious material and in conjunction with the rib members 34 and 36 will cause said material to be deposited in the form of a ribbon or bead of a uniformed height and width. Thus, a uniform bead or ribbon of cementitious material is deposited on the upper surface of the entire row of cement blocks and said ribbons or beads are uniformly spaced from the outer edge or face of the cement blocks for the entire course thereof due to the configuration of the dispensing nozzles 30 and also through the guide wheels 64 engaging the vertical side faces of said cement blocks. Thus, when the next or succeeding row or course of cement blocks is placed upon the beads or ribbons of cementitious material that has just been laid by the frame member 10 there will be uniform spacing between the rows or courses of cement blocks due to the fact that a uniform amount of cementitious material has been deposited upon the upper surface of each row or course of cement blocks.

The frame member 10 through the adjustment of the end members and segments 16, 18, 22 and 24 is capable of being used upon cement blocks of different sizes or widths. At the present time, cement blocks usually come in a standard length but the width of said blocks may be different as some blocks may be 8 inches wide and others 6 inches wide. As shown in FIGS. 2 and 3, the frame unit of the present invention is mounted upon cement blocks of the larger size with the supporting wheels 58, 54 and 44 moving along the top or upper surface of the blocks while the side or guide wheels 64 engage the outer faces of said blocks. In this arrangement the hoppers or containers 66 are mounted in and carried by the conduits 40 and said hoppers or containers have the lower portion or segments thereof formed with inclined sides 70 and 72 that terminate in a nozzle that is secured to the conduits 40 by means of the clamps 68.

The hoppers or containers 66, as shown in FIG. 3, have the sides 72 inclined at a greater angle to a vertical plane passing through the spout of said hopper than are the sides 70. The arrangement of the inclined sides 70 and 72 of the hoppers 66 readily permits the hoppers to be used with the mortar heads or dispensing nozzles 30 when the frame member 10 is mounted upon a large size cement block as well as when said frame is mounted upon a small size cement block, such as shown in FIG. 4. In FIGS. 4 it is to be noted that the hoppers 66 have been interchanged, from the arrangement as shown in FIG. 3, so that the inclined sides 72 which in FIG. 3 were positioned on the inner portion of the frame member 10 are now located on the outer side or portion of the frame member 10 as shown in FIG. 4. This interchangability of the hoppers is accomplished by the different angles of the inclined sides 70 and 72 with respect to a vertical plane passing through the discharged opening of said hoppers. As illustrated in FIG. 3 a vertical plane designated "A" extends through the discharged opening and through the conduit 40 whereas in FIG. 4 a vertical plane designated "B" passes through the discharged opening of the hopper and through the conduit 40. It is clearly shown in both FIGS. 3 and 4 that the vertical planes designated "A" and "B" are offset with respect to one another but with the inclined sides 72 adjacent one another the planes "A" of both hoppers or containers 66 extend through the center of the conduits as illustrated in FIG. 3. When the inclined sides 70 are disposed adjacent one another the planes "B" of the containers 66 extend through the center of the conduits 40. This adjustability of the hoppers 66 readily enables the frame unit 10 to be adjusted for different size cement blocks.

Regardless of the arrangement of the hoppers or containers 66 on the conduits 40 the frame member 10 in being moved over a row or course of blocks will cause a plurality of beads or ribbons of mortar to be deposited by the nozzles 30.

Although the foregoing description is necessarily of a detailed character in order that the invention may be completely set forth it is to be understood that the specific terminology is not intended to be restrictive or confining, and that various rearrangements of parts and modifications of detail may be resorted to without departing from the scope or spirit of the invention as herein claimed.

We claim:

1. A device for applying mortar to a course of masonry units being laid into a wall or the like with said units having side faces and a top surface, comprising, a frame member, a plurality of wheels connected to said frame member for supporting and moving said frame member along the top surface of said masonry units, dispensing nozzles mounted on said frame member for directing beads of mortar upon the top surface of said masonry units as said frame member is moved over said top surface, said frame member includes side elements arranged in spaced parallel relation to one another and adjustable end members for varying the spacing between said side elements and said dispensing nozzles, and mortar containers mounted on said dispensing nozzles.

2. A device for applying mortar as set forth in claim 1 wherein said end members each have one leg of an angle bracket affixed thereto with a wheel carried by the other leg and engaging the side face of said masonry units as said frame is moved over said top surface.

3. A device for applying mortar as set forth in claim 1 wherein said dispensing nozzles are mounted on and carried by one of the adjusting end members of said frame member.

4. A device for applying mortar as set forth in claim 3 wherein certain of said supporting wheels are mounted on one of said adjustable end members and certain other of said supporting wheels are mounted on said dispensing nozzles.

5. A device for applying mortar as set forth in claim 4 wherein one of said dispensing nozzles has a bar connected thereto with a handle connected to said bar for moving said frame member along said top surface on said supporting wheels.

6. A device for applying mortar as set forth in claim 1 wherein each of said dispensing nozzles includes a base member having a pair of spaced parallel rib members secured to the lower surface thereof with a transverse rib member connecting an end of the parallel rib members, an aperture in said base member adjacent said transverse rib and a conduct communicating with said aperture and disposed in a plane normal to said base member.

7. A device for applying mortar as set forth in claim 6 wherein mortar containers are detachably connected to said conduits.

8. A device for applying mortar as set forth in claim 7 wherein said containers terminate in inclined side portions that connect to said conduits with the angle of inclination of one side portion being different from that of another side portion to permit the adjustment of said containers commensurate with that of said dispensing nozzles.

* * * * *